US006881324B2

(12) United States Patent
Smith, Jr.

(10) Patent No.: US 6,881,324 B2
(45) Date of Patent: Apr. 19, 2005

(54) PROCESS FOR THE SIMULTANEOUS HYDROTREATING AND FRACTIONATION OF LIGHT NAPHTHA HYDROCARBON STREAMS

(75) Inventor: Lawrence A. Smith, Jr., Pasadena, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 120 days.

(21) Appl. No.: 10/382,761

(22) Filed: Mar. 6, 2003

(65) Prior Publication Data

US 2003/0230518 A1 Dec. 18, 2003

Related U.S. Application Data

(60) Provisional application No. 60/365,225, filed on Mar. 16, 2002.

(51) Int. Cl.[7] ..... C10G 45/02

(52) U.S. Cl. ..... 208/209; 208/210; 208/211; 208/212; 208/213; 208/218

(58) Field of Search ..... 208/209, 210, 208/211, 212, 213, 218

(56) References Cited

U.S. PATENT DOCUMENTS

| | | | | |
|---|---|---|---|---|
| 5,510,568 | A | 4/1996 | Hearn | 585/834 |
| 5,595,634 | A | 1/1997 | Hearn et al. | 203/29 |
| 5,597,476 | A | 1/1997 | Hearn et al. | 208/208 R |
| 5,779,883 | A | 7/1998 | Hearn et al. | 208/213 |
| 6,083,378 | A | 7/2000 | Gildert et al. | 208/209 |
| 6,231,752 | B1 | 5/2001 | Putman | 208/213 |
| 6,416,658 | B1 | 7/2002 | Maraschino et al. | 208/189 |
| 6,444,118 | B1 | 9/2002 | Podrebarac et al. | 208/210 |
| 6,495,030 | B1 | 12/2002 | Podrebarac | 208/218 |
| 2003/0136706 | A1 * | 7/2003 | McDaniel et al. | 208/97 |

* cited by examiner

*Primary Examiner*—Walter D. Griffin
(74) *Attorney, Agent, or Firm*—Kenneth H. Johnson

(57) ABSTRACT

A process for the treatment of light naphtha hydrocarbon streams is disclosed wherein the mercaptans contained therein are reacted with diolefins simultaneous with fractionation into a light stream and a heavy stream. The heavy stream is then simultaneously treated at high temperatures and low pressures and fractionated. The naphtha is then stripped of the hydrogen sulfide in a final stripper.

6 Claims, 2 Drawing Sheets

PROCESS FOR THE SIMULTANEOUS HYDROTREATING AND FRACTIONATION OF LIGHT NAPHTHA HYDROCARBON STREAMS

This application claims the benefit of provisional application 60/365,225 filed Mar. 16, 2002.

BACKGROUND OF THE INVENTION

1. Field of the Invention

The present invention relates to a process for concurrently fractionating and hydrotreating a full range naphtha stream. More particularly the full boiling range naphtha stream is subjected to simultaneous hydrodesulfurization and splitting into a light boiling range naphtha and a heavy boiling range naphtha. The two boiling range naphthas are treated separately according to the amount of sulfur in each cut and the end use of each fraction.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycyclic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized naphtha.

In addition to supplying high octane blending components, the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the olefins in the cracked naphtha are mainly in the low boiling fraction of these naphthas and the sulfur containing impurities tend to be concentrated in the high boiling fraction the most common solution has been prefractionation prior to hydrotreating. The prefractionation produces a light boiling range naphtha which boils in the range of $C_5$ to about 250° F. and a heavy boiling range naphtha which boils in the range of from about 250–475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

After treating the lighter portion of the naphtha to remove the mercaptans it has been traditional been to feed the treated material a catalytic reforming unit to increase the octane number if necessary. Also the lighter fraction may be subjected to further separation to remove the valuable $C_5$ olefins (amylenes) which are useful in preparing ethers.

Recently several a new process has been proposed wherein a hydrocarbon stream is desulfurized using simultaneous reaction and distillation to achieve desired levels of desulfurization. This process is described in commonly owned U.S. Pat. No. 5,779,883. The simultaneous distillation and desulfurization of naphtha, especially cracked naphtha, has been used to achieve the desired level of desulfurization while retaining the desirable olefins. This use is disclosed in various configurations in commonly owned U.S. Pat. Nos. 5,597,476; 6,083,378 and 6,090,270.

SUMMARY OF THE INVENTION

Briefly the present invention utilizes a naphtha splitter as a distillation column reactor to treat a portion or all of the naphtha to remove the organic sulfur compounds contained therein. The catalyst is placed in the distillation column reactor such that the selected portion of the naphtha is contacted with the catalyst and treated under the appropriate conditions of temperature and pressure. The catalyst is placed in the stripping section to treat the higher boiling range components only. The catalyst bed is operated at much higher temperatures than in the prior art, above 500° F., preferably above 570° F., e.g., 600–650° F., while utilizing pressures below 300 psig, preferably below 200 psig, e.g., 150–200 psig. To assure a mixed phase in the reactor a low sulfur gas oil, such as diesel, which boils in the desired range at the pressure within the column, may be injected and recycled. Because the energy of activation for the desulfurization reaction is higher than that for the saturation of olefins, a higher desulfurization level can be achieved at the higher temperature without concurrent loss of olefins.

In another embodiment the naphtha and gas oil is fed to a downflow single pass reactor containing a hydrodesulfurization catalyst wherein the temperature is such that there is a boiling mixture in the bed. Again, because the temperatures are higher than normal the gas oil is included.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure.

DETAILED DESCRIPTION OF THE INVENTION

Figure 1:
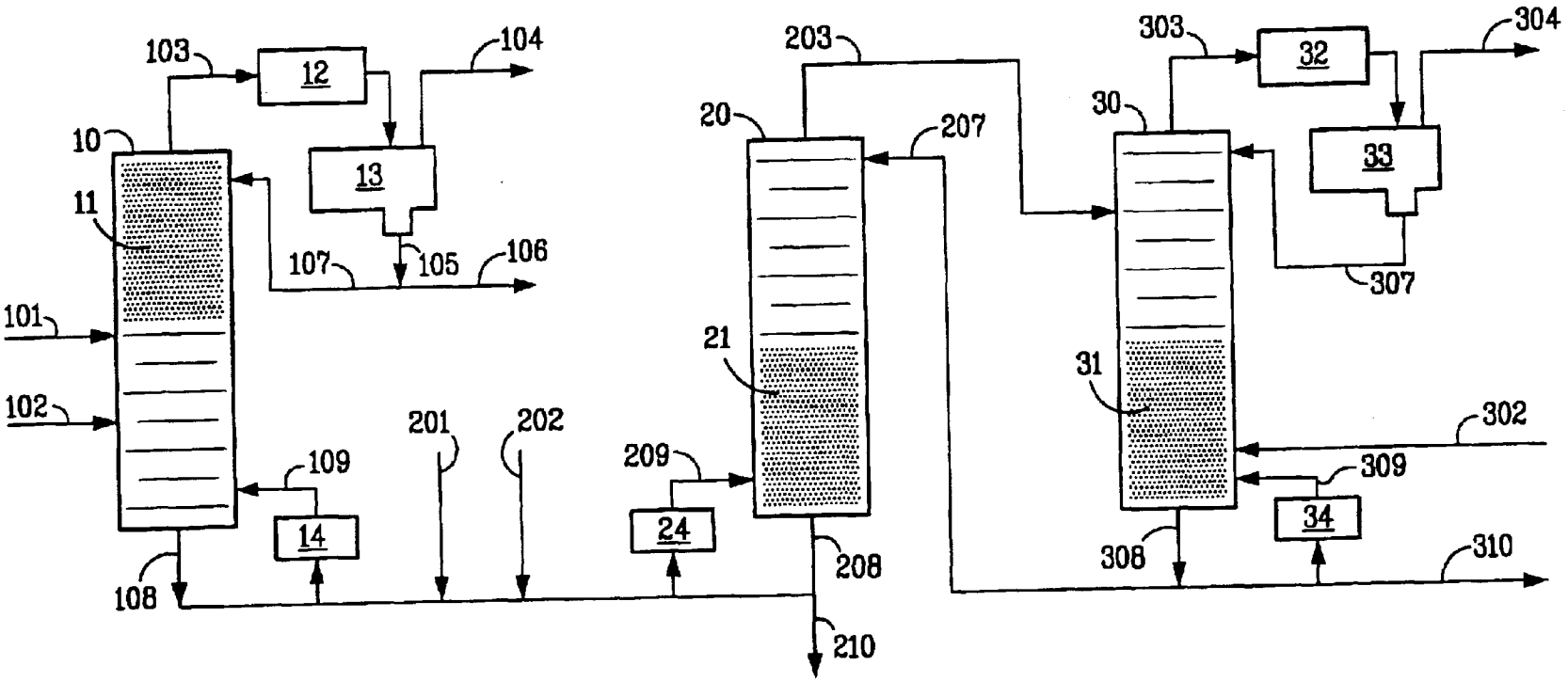
FIG. 1 is a simplified flow diagram of one embodiment of the invention.

The feed to the process comprises a sulfur-containing petroleum fraction which boils in the gasoline boiling range. Feeds of this type include light naphthas having a boiling range of about $C_5$ to 330° F. and full range naphthas having a boiling range of $C_5$ to 420° F. Generally the process is useful on the naphtha boiling range material from catalytic cracker products because they contain the desired olefins and unwanted sulfur compounds. Straight run naphthas have very little olefinic material, and very little sulfur unless the crude source is "sour".

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and disulfides.

The reaction of these mercaptans with diolefins contained within the naphtha is called thioetherification and the products are higher boiling sulfides. A suitable catalyst for the reaction of the diolefins with the mercaptans is 0.4 wt. % Pd on 7 to 14 mesh $Al_2O_3$ (alumina) spheres, supplied by S üd-Chemie (formerly United Catalyst Inc.), designated as G-68C. Typical physical and chemical properties of the catalyst as provided by the manufacturer are as follows:

TABLE I

| | |
|---|---|
| Designation | G-68C |
| Form | Sphere |
| Nominal size | 7 × 14 mesh |
| Pd. wt. % | 0.4 (0.37–0.43) |
| Support | High purity alumina |

Another catalyst useful for the mercaptan-diolefin reaction is 58 wt. % Ni on 8 to 14 mesh alumina spheres, supplied by Calcicat, designated as E-475-SR. Typical physical and chemical properties of the catalyst as provided by the manufacturer are as follows:

TABLE II

| | |
|---|---|
| Designation | E-475-SR |
| Form | Spheres |
| Nominal size | 8 × 14 Mesh |
| Ni wt. % | 54 |
| Support | Alumina |

The hydrogen rate to the reactor must be sufficient to maintain the reaction, but kept below that which would cause flooding of the column which is understood to be the "effectuating amount of hydrogen" as that term is used herein. The mole ratio of hydrogen to diolefins and acetylenes in the feed is at least 1.0 to 1.0 and preferably 2.0 to 1.0.

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

Catalyst which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts contain components from Group V, VIB, VIII metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams. The catalyst may also catalyze the hydrogenation of the olefins and polyolefins contained within the light cracked naphtha and to a lesser degree the isomerization of some of the mono-olefins. The hydrogenation, especially of the mono-olefins in the lighter fraction may not be desirable.

The properties of a typical hydrodesulfurization catalyst are shown in Table III below.

TABLE III

| | |
|---|---|
| Manufacture | Criterion Catalyst Co. |
| Designation | C-448 |
| Form | Tri-lobe Extrudate |
| Nominal size | 1.2 mm diameter |
| Metal, Wt. % | |
| Cobalt | 2–5% |
| Molybdenum | 5–20% |
| Support | Alumina |

The catalyst typically is in the form of extrudates having a diameter of 1/8, 1/16 or 1/32 inches and an L/D of 1.5 to 10. The catalyst also may be in the form of spheres having the same diameters. They may be directly loaded into standard single pass fixed bed reactors which include supports and reactant distribution structures. However, in their regular form they may result in too compact a mass for use in a distillation column and must then be prepared in the form of a catalytic distillation structure. The catalytic distillation structure must be able to function as catalyst and as mass transfer medium. The catalyst must be suitably supported and spaced within the column to act as a catalytic distillation structure. In a preferred embodiment the catalyst is contained in a woven wire mesh structure as disclosed in U.S. Pat. No. 5,266,546, which is hereby incorporated by reference. Another preferred structure comprises catalyst contained in a plurality of wire mesh tubes closed at either end and laid across a sheet of wire mesh fabric such as demister wire. The sheet and tubes are then rolled into a bale for loading into the distillation column reactor. This embodiment is described in U.S. Pat. No. 5,431,890 which is hereby incorporated by reference. Other preferred catalytic distillation structures useful for this purpose are disclosed in U.S. Pat. Nos. 4,731,229, 5,073,236, 5,431,890 and 5,730,843 which are also incorporated by reference.

The conditions suitable for the desulfurization of naphtha in a distillation column reactor are very different from those in a standard trickle bed reactor, especially with regard to total pressure and hydrogen partial pressure. Typical conditions in a reaction distillation zone of a naphtha hydrodesulfurization distillation column reactor are:

| | |
|---|---|
| Temperature | 450–700° F. |
| Total Pressure | 75–300 psig |
| $H_2$ partial pressure | 6–75 psia |
| LHSV of naphtha | about 1–5 |
| $H_2$ rate | 10–1000 SCFB |

The operation of the distillation column reactor results in both a liquid and vapor phase within the distillation reaction zone. A considerable portion of the vapor is hydrogen while a portion is vaporous hydrocarbon from the petroleum fraction. Actual separation may only be a secondary consideration.

Without limiting the scope of the invention it is proposed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

It is believed that in the present distillation column reaction is a benefit first, because the reaction is occurring concurrently with distillation, the initial reaction products and other stream components are removed from the reaction zone as quickly as possible reducing the likelihood of side reactions. Second, because all the components are boiling the temperature of reaction is controlled by the boiling point of the mixture at the system pressure. The heat of reaction simply creates more boil up, but no increase in temperature at a given pressure. As a result, a great deal of control over the rate of reaction and distribution of products can be achieved by regulating the system pressure. A further benefit that this reaction may gain from distillation column reactions is the washing effect that the internal reflux provides to the catalyst thereby reducing polymer build up and coking.

Finally, the upward flowing hydrogen acts as a stripping agent to help remove the $H_2S$ which is produced in the distillation reaction zone.

Because the temperatures utilized in the distillation column of the present invention may be higher that the boiling point of the cracked naphtha at the column pressure, a gas oil may be used to provide a liquid phase. The desired temperature within the catalyst bed is between 600–700° F. at total pressures of between 200–250 psig. A good gas oil stock useful for this purpose is a low sulfur diesel oil.

Referring now to the FIG. 1 a simplified flow diagram of the preferred embodiment of the invention is shown. The full boiling range naphtha is fed to a first distillation column reactor 10 via flow line 101 and hydrogen is fed via line 102. The distillation column reactor 10 contains a bed of thioetherification catalyst 11 in the rectification section where the diolefins contained within the naphtha are reacted with the mercaptans to form sulfides. A light naphtha containing $C_5$'s and $C_5$'s is taken overhead along with hydrogen via flow line 103. The condensible material is condensed in partial condenser 12 and collected in receiver/separator 13. Uncondensed gases are removed via flow line 104. The liquid is withdrawn via flow line 105 with product being removed via flow line 106. A portion of the liquid is returned to the distillation column reactor 10 as reflux via flow line 107. The liquid product contains very little sulfur and most of the olefins and is suitable for gasoline blending or for etherification. Bottoms are removed from the first distillation column reactor 10 via flow line 108 with a portion being recirculated through reboiler 14 and flow line 109 to provide heat for the reaction.

Gas oil is added to the remainder of the bottoms from the first distillation column reactor 10 via flow line 201 and hydrogen added via flow line 202 and the combined bottoms, gas oil, and hydrogen are passed through reboiler 24 and fed to a second distillation column reactor 20. The second distillation column reactor 20 contains a bed of hydrodesulfurization catalyst 21 within the stripping section wherein the remaining organic sulfur compound, mostly thiophenes and other thiophenic compounds, are reacted with hydrogen to form hydrogen sulfide. While the thiophenic materials are being reacted there is some recombinant mercaptans which may be formed.

A bottoms stream is removed and via flow line 208 and recirculated along with the feed through reboiler 24 and flow line 209 to provide necessary heat for the reaction. A slip stream of gas oil may be removed to prevent build up.

All of the naphtha is taken as overheads along with the hydrogen sulfide via flow line 203 and fed to a third distillation column reactor 30 containing a bed 31 of a milder hydrodesulfurization catalyst in the stripping section, milder being a comparative term indicating that the catalyst has less hydrodesulfurization activity than the catalyst in the second distillation column reactor 20. Gas oil may also be removed via flow line 203 as required to maintain the column temperature profile of distillation column reactor 20. Hydrogen is fed via flow line 302. Therein the recombinant mercaptans are converted to hydrogen sulfide and olefins with the all of the hydrogen sulfide being removed as overheads along with a medium naphtha product via flow line 303. The overheads are passed through partial condenser 32 and the liquid collected in receiver/separator 33. The gases, mostly hydrogen sulfide, is removed via flow line 304 and liquid via flow line 307. All of the liquid is returned to the third distillation column reactor 30 as reflux via flow line 307. The overall function of the third distillation column reactor 30 is to strip all of the hydrogen sulfide from the product which is removed as bottoms via flow line 308. A portion of the bottoms is returned to the second distillation column reactor 20 via flow line 207 for reflux. The low sulfur naphtha product is taken via flow line 310 for gasoline blending.

Figure 2:
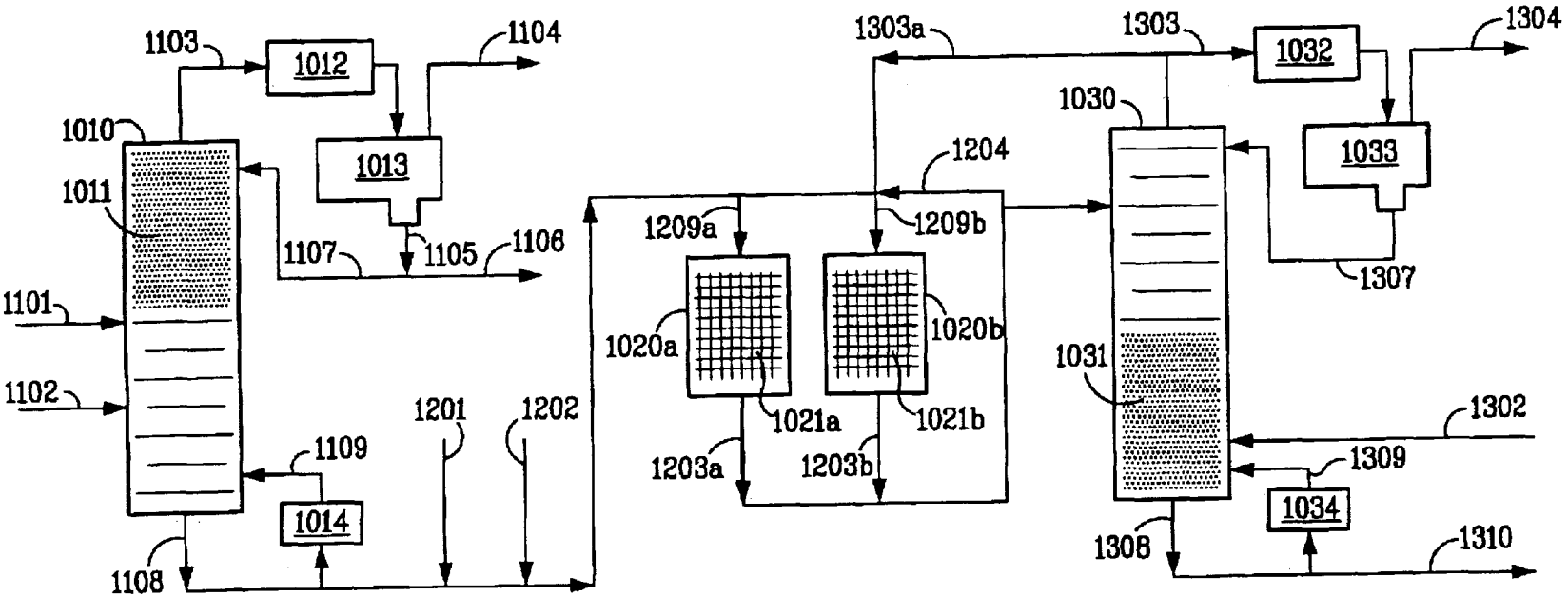
FIG. 2 is a simplified flow diagram of a second embodiment of the invention.

A second embodiment of the invention is shown in FIG. 2. The main difference is that the distillation column reactor 20 of FIG. 1 has been replaced with two standard downflow trickle bed reactor 1020*a* and 1020*b*. In addition the gas oil is not used in the two reactors. As in the first embodiment the full boiling range naphtha is fed to a first distillation column reactor 1010 via flow line 1101 and hydrogen is fed via line 1102. The distillation column reactor 1010 contains a bed of thioetherification catalyst 1011 in the rectification section where the diolefins contained within the naphtha are reacted with the mercaptans to form sulfides. A light naphtha containing $C_5$'s and $C_6$'s is taken overhead along with hydrogen via flow line 1103. The condensible material is condensed in partial condenser 1012 and collected in receiver/separator 1013. Uncondensed gases are removed via flow line 1104. The liquid is withdrawn via flow line 1105 with product being removed via flow line 1106. A portion of the liquid is returned to the distillation column reactor 1010 as reflux via flow line 1107. The liquid product contains very little sulfur and most of the olefins and is suitable for gasoline blending or for etherification. Bottoms are removed from the first distillation column reactor 1010 via flow line 1108 with a portion being recirculated through reboiler 1014 and flow line 1109 to provide heat for the reaction.

The bottoms are then fed via flow line 1209, with hydrogen from flow line 1201 to either of standard downflow trickle bed reactors 1020*a* or 1020*b*, both of which contain bed 1021*a* and 1021*b* of hydrodesulfurization catalyst. The reactors 1020*a* and 1020*b* are operated at conditions of temperature sufficient to convert the majority of the organic sulfur compounds to hydrogen sulfide. The pressure in the reactors is low (in the range of 50 psig with a hydrogen partial pressure of about 25 psia). Because the operating pressures are low, the catalyst tends to age fairly rapidly. It has been found that hot hydrogen stripping is sufficient to reactivate the catalyst. Thus the two reactors are operated in tandem with one being regenerate with hot hydrogen via flow line 1303*a* while the other is in service The temperatures are relatively high, i.e., above 600° F. The space velocities (volume of feed per volume of catalyst per hour) may be high with highly active catalyst or low with lower activity catalyst. While the thiophenic materials are being reacted there are some recombinant mercaptans, which may be formed at the outlet of the reactors.

All of the naphtha along with the hydrogen sulfide is fed via flow line 1203 and fed to a distillation column reactor 1030 (a small recycle stream may be fed from flow line 1203 via flow line 1204 to trickle bed reactors 1020*a* and 1020*b* to keep the catalyst beds 1021*a* and 1021*b* wet) containing a bed 1031 of a mild hydrodesulfurization catalyst (as noted above) in the stripping section. Hydrogen is fed via flow line 1302. Therein the recombinant mercaptans are converted to hydrogen sulfide and olefins with the all of the hydrogen sulfide being removed as overheads along with a medium naphtha product via flow line 1303. The overheads are passed through partial condenser 1032 and the liquid collected in receiver/separator 1033. The gases, mostly hydrogen sulfide, are removed via flow line 1304 and liquid via flow line 1307. All of the liquid is returned to the third distillation column reactor 1030 as reflux via flow line 1307. The overall function of the third distillation column reactor 1030 is to strip all of the hydrogen sulfide from the product which is removed as bottoms via flow line 1308. The low sulfur naphtha product is taken via flow line 1310 for gasoline blending.

The invention claimed is:

1. A process for the desulfurization of a fluid cracked naphtha comprising the steps of:

(a) feeding hydrogen and a fluid cracked naphtha containing organic sulfur compounds to a distillation column reactor containing a bed of hydrodesulfurization catalyst;

(b) concurrently in said distillation column reactor (i) contacting said organic sulfur compounds and said hydrogen in the presence of said hydrodesulfurization catalyst at temperature above 500° F. and pressures below 300 psig thereby reacting a portion of said organic sulfur compounds with hydrogen to form hydrogen sulfide;

(ii) fractionating said fluid cracked naphtha into two fractions by fractional distillation, (c) removing a naphtha product as overheads from said distillation column reactor, said naphtha product having a lower sulfur content than the fluid cracked naphtha feed; and (d) feeding gas oil to said distillation column reactor whereby a liquid phase within said distillation column at the reaction conditions is assured.

2. The process according to claim 1 wherein the cracked naphtha is first subjected to thioetherification prior to feeding to said distillation column reactor.

3. The process according to claim 2 wherein said thioetherification is carried out in a second distillation column reactor wherein a light naphtha product containing $C_5$'s and $C_6$'s is taken as a second overheads and a heavy naphtha product is taken as a second bottoms, said second bottoms comprising the cracked naphtha feed of step (a).

4. The process according to claim 1 wherein the naphtha product is fed to a hydrogen sulfide stripper wherein the hydrogen sulfide is stripped from the product.

5. A process for the desulfurization of a fluid cracked naphtha comprising the steps of:

(a) feeding hydrogen and a fluid cracked naphtha containing olefins, diolefins, mercaptans and other organic sulfur compounds to a first distillation column reactor containing a bed of thioetherification catalyst;

(b) concurrently in said first distillation column reactor (i) reacting substantially all of the mercaptans with a portion of said diolefins to form a reaction mixture containing sulfides and naphtha (ii) fractionating the reaction mixture to separate out a first overheads containing a $C_5$–$C_6$ boiling material substantially free of mercaptans or other organic sulfur compounds and a first bottoms containing a $C_6$+ boiling material containing said sulfides;

(c) feeding said $C_6$+ bottoms, gas oil and hydrogen to a second distillation column reactor;

(d) concurrently in said second distillation column reactor;

(i) contacting said organic sulfur compounds and said hydrogen in the presence of said hydrodesulfurization catalyst at temperature above 570° F. and pressures below 200 psig thereby reacting a portion of said organic sulfur compounds with hydrogen to form hydrogen sulfide;

(ii) separating the naphtha from the gas oil by fractional distillation;

(e) removing the naphtha and hydrogen sulfide from said second distillation column reactor as a second overheads;

(f) removing the gas oil from said second distillation column reactor as a second bottoms;

(g) feeding said second overheads and hydrogen to a hydrogen sulfide stripper configured as a third distillation column reactor containing a bed of hydrodesulfurization catalyst;

(h) concurrently in said third distillation column reactor;

(i) contacting said naphtha and hydrogen in the presence of said hydrodesulfurization catalyst thereby converting any mercaptans contained within said second overheads to olefins and hydrogen sulfide; and (ii) stripping the hydrogen sulfide from said second overheads by fractional distillation;

(i) removing the hydrogen sulfide from said third distillation column reactor as a third overheads; and (j) removing naphtha product from said third distillation column reactor as bottoms.

6. A process for the desulfurization of a fluid cracked naphtha comprising the steps of:

(a) feeding hydrogen and a fluid cracked naphtha containing olefins, diolefins, mercaptans and other organic sulfur compounds to a first distillation column reactor containing a bed of thioetherification catalyst;

(b) concurrently in said first distillation column reactor (i) reacting substantially all of the mercaptans with a portion of said diolefins to form a reaction mixture containing sulfides and naphtha (ii) fractionating the reaction mixture to separate out a first overheads containing a $C_5$–$C_6$ boiling material substantially free of mercaptans or other organic sulfur compounds and a first bottoms containing a $C_6$+ boiling material containing said sulfides;

(c) feeding said $C_6$+ bottoms, gas oil and hydrogen to a first of two downflow trickle bed reactors connected in tandem, each containing a hydrodesulfurization catalyst wherein said organic sulfur compounds and said hydrogen are contacted in the presence of said hydrodesulfurization catalyst at temperature above 600° F. and pressures below 250 psig thereby reacting a portion of said organic sulfur compounds with hydrogen to form hydrogen sulfide;

(d) feeding hot hydrogen to the second of said downflow trickle bed reactors;

(e) feeding the effluent from said first downflow trickle bed reactor and hydrogen to a hydrogen sulfide stripper configured as a third distillation column reactor containing a bed of hydrodesulfurization catalyst;

(f) concurrently in said third distillation column reactor;

(i) contacting said naphtha and hydrogen in the presence of said hydrodesulfurization catalyst thereby converting any mercaptans contained within said second overheads to olefins and hydrogen sulfide; and (ii) stripping the hydrogen sulfide from said second overheads by fractional distillation;

(g) removing the hydrogen sulfide from said third distillation column reactor as a third overheads; and (h) removing naphtha product from said third distillation column reactor as bottoms.

* * * * *